US007500338B2

(12) United States Patent
Spatafora et al.

(10) Patent No.: US 7,500,338 B2
(45) Date of Patent: Mar. 10, 2009

(54) METHOD AND UNIT FOR HEAT-SHRINKING OVERWRAPPINGS OF HEAT-SHRINK PLASTIC MATERIAL OF A SUCCESSION OF PRODUCTS

(75) Inventors: Mario Spatafora, Granarolo (IT); Enrico Campagnoli, S. Agata Bolognese (IT); Fabrizio Tale', Bologna (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 11/839,076

(22) Filed: Aug. 15, 2007

(65) Prior Publication Data

US 2008/0053043 A1 Mar. 6, 2008

(30) Foreign Application Priority Data

Aug. 17, 2006 (IT) ..... BO2006A0611

(51) Int. Cl.
*B65B 53/02* (2006.01)
*B65G 37/00* (2006.01)

(52) U.S. Cl. ..... 53/442; 53/557; 198/469.1; 198/459.2

(58) Field of Classification Search ..... 53/442, 53/447, 498, 127, 557; 198/459.2, 469.1, 198/478.1, 476.1
See application file for complete search history.

(56) References Cited

U.S. PATENT DOCUMENTS 2,037,631 A 4/1936 Hultin
2,277,408 A * 3/1942 Molins et al. ..... 53/73
3,115,735 A * 12/1963 Harrison ..... 53/557
3,381,443 A * 5/1968 Copping ..... 53/442
3,616,546 A * 11/1971 Billingsley et al. ..... 34/217
3,782,070 A * 1/1974 Erlandson ..... 53/557
3,896,604 A * 7/1975 Marantz ..... 53/176
4,050,216 A * 9/1977 Stenberg ..... 53/413
4,289,236 A * 9/1981 Ganz et al. ..... 206/432
4,349,399 A * 9/1982 Obrist et al. ..... 156/86
5,050,368 A * 9/1991 Noh ..... 53/442
7,131,247 B2 * 11/2006 Boriani et al. ..... 53/442
7,328,560 B2 * 2/2008 Martelli ..... 53/564
2005/0198928 A1 * 9/2005 Boriani et al. ..... 53/442
2008/0053043 A1 * 3/2008 Spatafora et al. ..... 53/442

FOREIGN PATENT DOCUMENTS

EP 1055603 11/2000

* cited by examiner

*Primary Examiner*—Paul R Durand
(74) *Attorney, Agent, or Firm*—McCarter & English, LLP

(57) ABSTRACT

A method and unit for heat-shrinking overwrappings of heat-shrink plastic material of a succession of products; an orderly succession of products is conveyed by conveying means; each product is subjected to a first heat-shrink operation along the conveying means and by means of a first heat-shrink device; and each product is subjected to a second heat-shrink operation along the conveying means and by means of a second heat-shrink device separate and at a distance from the first heat-shrink device.

7 Claims, 5 Drawing Sheets

METHOD AND UNIT FOR HEAT-SHRINKING OVERWRAPPINGS OF HEAT-SHRINK PLASTIC MATERIAL OF A SUCCESSION OF PRODUCTS

TECHNICAL FIELD

The present invention relates to a method and unit for heat-shrinking overwrappings of heat-shrink plastic material of a succession of products.

The present invention may be used to advantage when feeding packets of cigarettes from a cellophaning machine to a cartoning machine, to which the following description refers purely by way of example.

BACKGROUND ART

Once an overwrapping of heat-shrink plastic material is applied to a packet of cigarettes, the packet of cigarettes is normally heated to a temperature below the melting temperature of the plastic material to heat-shrink and so better smooth the overwrapping about the packet of cigarettes. On currently marketed machines, however, heat-shrinking the overwrapping of heat-shrink plastic material involves a number of flaws, by failing to smooth the overwrapping of heat-shrink plastic material effectively over the whole surface.

DISCLOSURE OF THE INVENTION

It is an object of the present invention to provide a method and unit for heat-shrinking overwrappings of heat-shrink plastic material of a succession of products, which method and unit are designed to eliminate the aforementioned drawbacks, while at the same time being cheap and easy to implement.

According to the present invention, there are provided a method and unit for heat-shrinking overwrappings of heat-shrink plastic material of a succession of products, as claimed in the attached Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
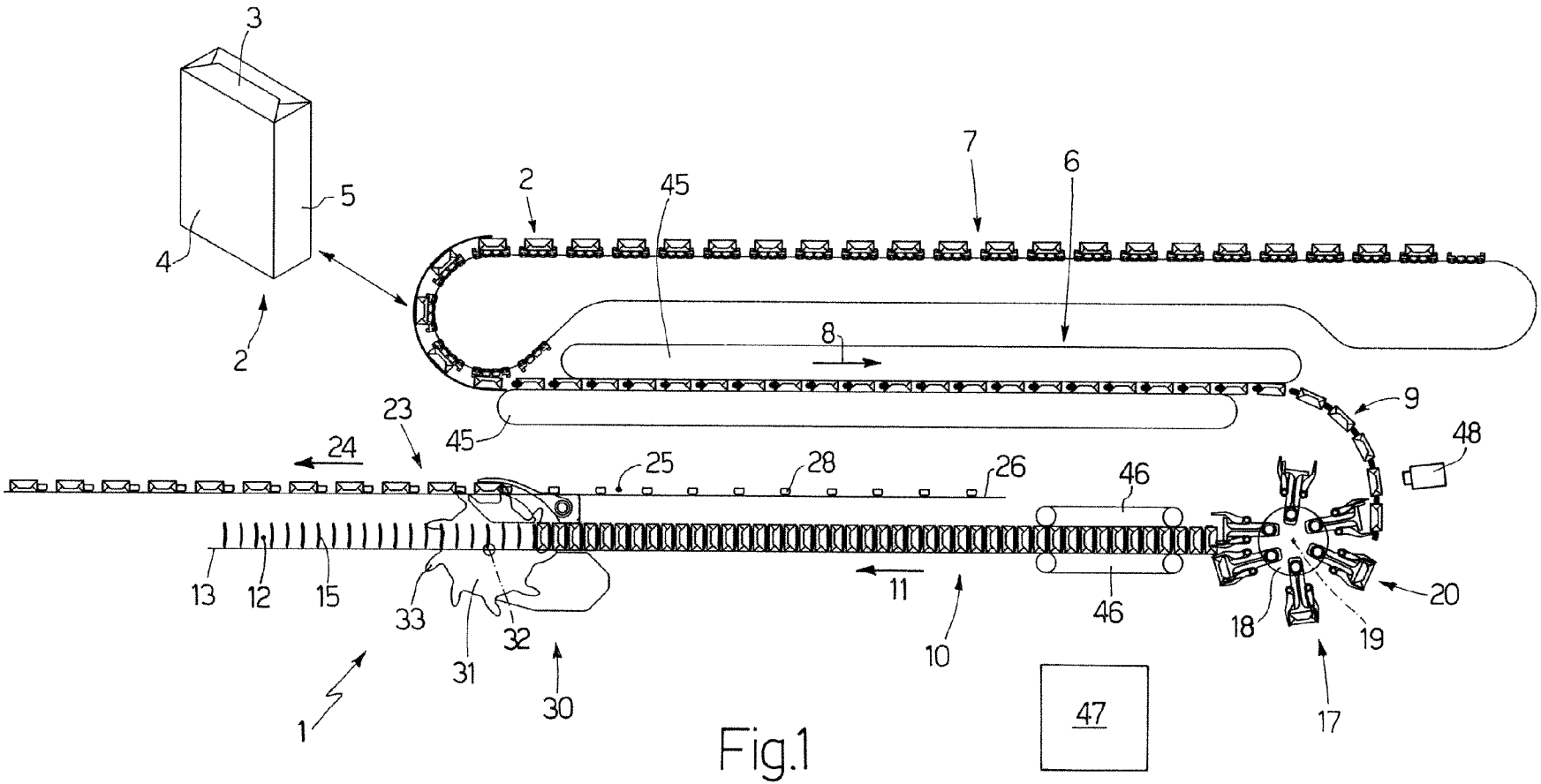
FIG. 1 shows a schematic side view, with parts removed for clarity, of a unit for feeding packets of cigarettes from a cellophaning machine to a cartoning machine, in accordance with the present invention.

Number 1 in FIG. 1 indicates as a whole a unit for feeding packets 2 of cigarettes from a cellophaning machine (not shown) to a cartoning machine (not shown), which comprises a group-forming unit (not shown) for forming packets 2 of cigarettes into groups, each comprising a given number of (normally ten) packets 2 of cigarettes.

Each packet 2 of cigarettes has an overwrapping of heat-shrink plastic material applied by the cellophaning machine, is in the form of a rectangular parallelepiped, and comprises two parallel end walls 3 (only one shown in FIG. 1), two parallel major lateral walls 4 (only one shown in FIG. 1), and two parallel minor lateral walls 5 (only one shown in FIG. 1).

Feed unit 1 comprises a conveyor 6, which receives packets 2 of cigarettes from a heat-seal conveyor 7 of the cellophaning machine, along which the superimposed portions of the overwrapping of plastic material at the two end walls 3 of each packet 2 of cigarettes are heat sealed. Conveyor 6 feeds an orderly succession of packets 2 of cigarettes in a direction 8, and comprises a succession of pockets 9, each housing a respective packet 2 of cigarettes. In a preferred embodiment shown in FIG. 1, conveyor 6 comprises a conveying surface having a flat, horizontal initial portion and a curved end portion; and a number of push members defining pockets 9 and which push packets 2 of cigarettes along the conveying surface.

Feed unit 1 comprises a conveyor 10, which is located below conveyor 6, feeds an orderly succession of packets 2 of cigarettes in a horizontal direction 11, and comprises a succession of pockets 12, each housing a respective packet 2 of cigarettes. In a preferred embodiment shown in FIG. 4, conveyor 10 comprises a centrally split conveying surface 13, along which packets 2 of cigarettes travel; and two lateral conveyor belts 14, each having a number of push members 15 defining pockets 12. More specifically, conveying surface 13 is split centrally to define a central opening 16.

Figure 2:
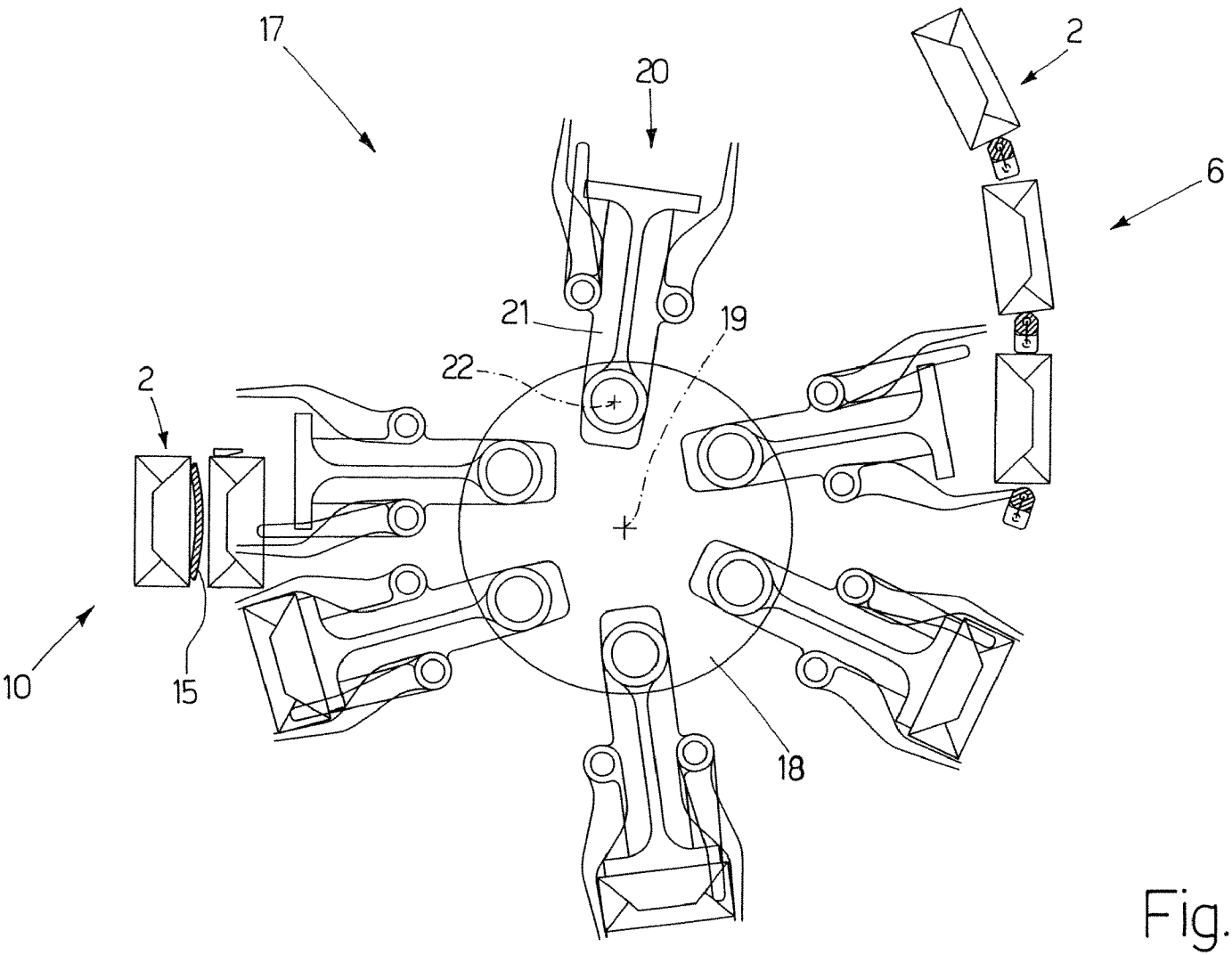
FIG. 2 shows a larger-scale view, with parts removed for clarity, of a first transfer device of the FIG. 1 feed unit.

As shown in FIGS. 1 and 2, feed unit 1 comprises a transfer device 17 for transferring packets 2 of cigarettes from conveyor 6 to conveyor 10. Transfer device 17 comprises a wheel 18, which rotates about a horizontal axis of rotation 19 perpendicular to the FIGS. 1 and 2 planes, and supports a number of pickup members 20, each of which removes a packet 2 of cigarettes from the output end of conveyor 6, and feeds the packet 2 of cigarettes to the input end of conveyor 10. Each pickup member 20 is fitted to an arm 21 hinged to wheel 18 to rotate, with respect to wheel 18 and under the control of a cam system (not shown), about an axis of rotation 22 parallel to axis of rotation 19.

Each pickup member 20 is preferably defined by a gripper having two jaws movable between a grip position, in which the two jaws are a minimum distance apart, and a release position, in which the two jaws are a maximum distance apart.

Figure 4:
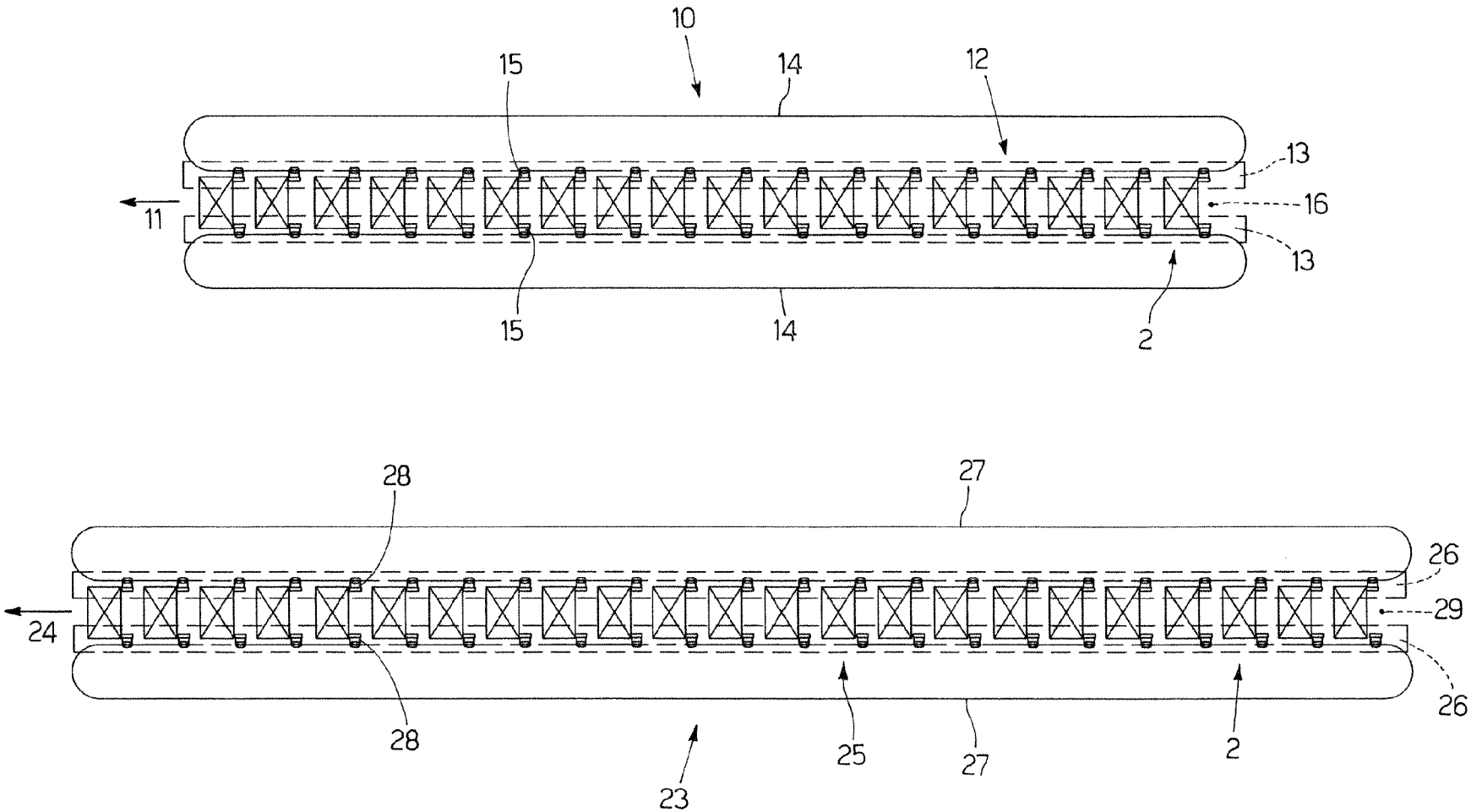
FIG. 4 shows a larger-scale plan view, with parts removed for clarity, of two conveyors of the FIG. 1 feed unit.

As shown in FIGS. 1 and 4, feed unit 1 comprises a conveyor 23, which feeds an orderly succession of packets 2 of cigarettes in a direction 24 parallel to direction 11, and comprises a succession of pockets 25, each housing a respective packet 2 of cigarettes. In a preferred embodiment shown in FIG. 4, conveyor 23 comprises a centrally split conveying surface 26, along which packets 2 of cigarettes travel; and two lateral conveyor belts 27, each having a number of push members 28 defining pockets 25. More specifically, conveying surface 26 is split centrally to define a central opening 29.

Figure 3:
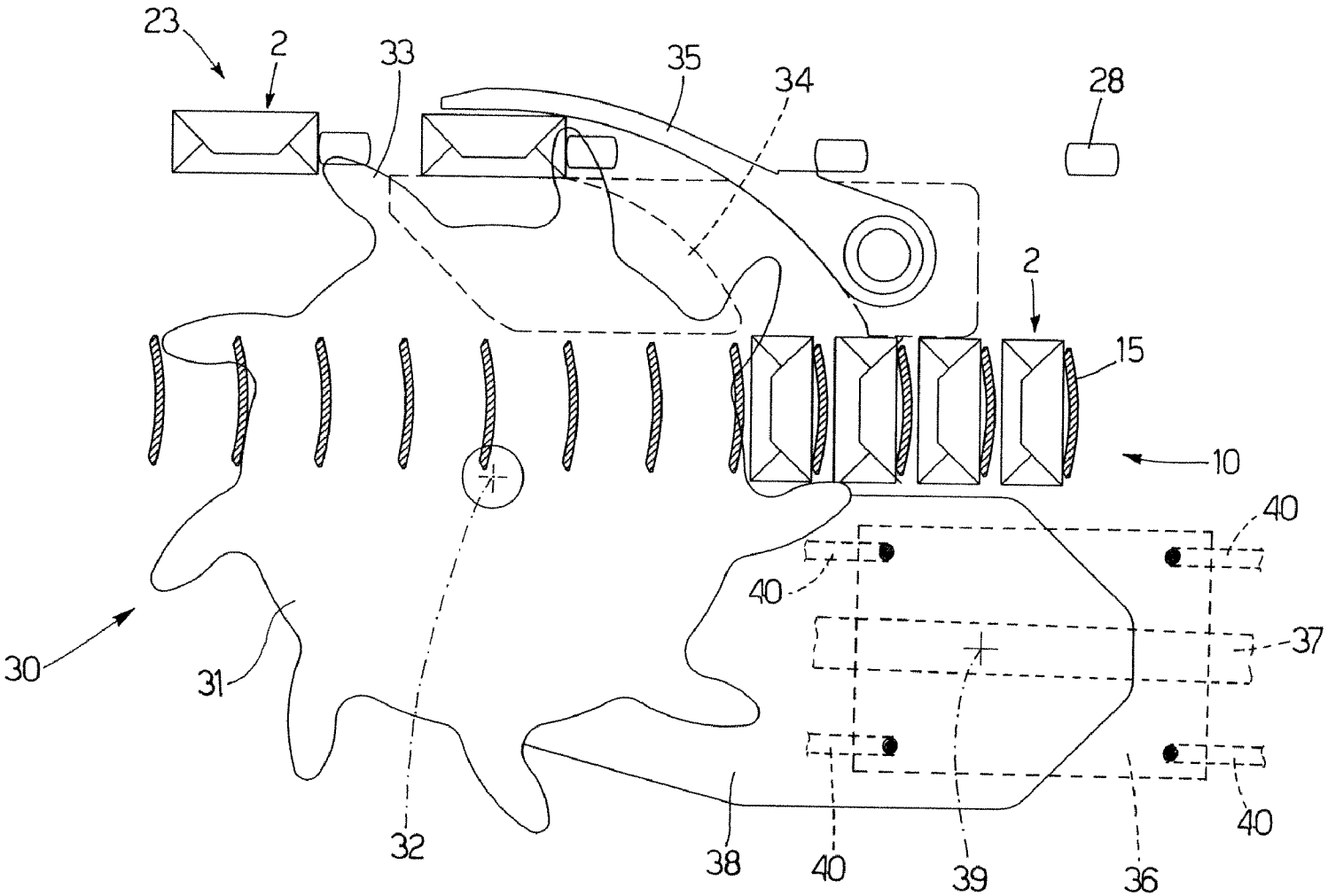
FIG. 3 shows a larger-scale view, with parts removed for clarity, of a second transfer device of the FIG. 1 feed unit.

As shown in FIGS. 1 and 3, feed unit 1 comprises a transfer device 30 for transferring packets 2 of cigarettes from conveyor 10 to conveyor 23. As described in detail below, transfer device 30 is movable both horizontally back and forth in direction 11, and vertically perpendicular to direction 11.

Transfer device 30 comprises a wheel 31, which rotates about a horizontal axis of rotation 32 parallel to axes of rotation 19 and 22, and supports a number of push members 33, each of which removes a packet 2 of cigarettes from a pocket 12 of conveyor 10, and feeds the packet 2 of cigarettes to a pocket 25 of conveyor 23. More specifically, each push member 33 is defined by a hook projecting from the lateral surface of wheel 31. Transfer device 30 also comprises a bottom plate 34 and a top plate 35 defining, in between, a feed channel along which each packet 2 of cigarettes is pushed by a push member 33. In other words, the feed channel is bounded internally by a curved surface of bottom plate 34, and externally by a curved surface of top plate 35. Top plate 35 is arc-shaped, and extends about wheel 31 to guide packets 2 of cigarettes. Preferably, top plate 35 is hinged to rotate between a work position (shown in the drawings) and a maintenance position, and is held in the work position by a push member (e.g. an air spring).

It is important to note that wheel 31 and plates 34 and 35 are small enough transversely (in width) to fit inside openings 16 and 29 of conveyors 10 and 23, so that the on-edge wheel 31 can move freely back and forth in direction 11 with respect to both conveyors 10 and 23, and a packet 2 of cigarettes can be engaged simultaneously by conveyor 10 or 23 (which engages packet 2 of cigarettes laterally) and by wheel 31 (which engages packet 2 of cigarettes centrally).

In a preferred embodiment shown in FIG. 3, to assist removal of a packet 2 of cigarettes from a pocket 12 of conveyor 10, push members 15 of conveyor 10 are the same curved shape as the feed channel defined between bottom plate 34 and top plate 35 of transfer device 30.

Finally, transfer device 30 comprises a carriage 36, which supports wheel 31 and is mounted to run along a guide 37 parallel to direction 11. More specifically, an arm 38 is hinged at a first end to carriage 36 to rotate about an axis of rotation 39 parallel to axis of rotation 32, and, at a second end, supports wheel 31 in rotary manner. Arm 38 also supports bottom plate 34 and top plate 35.

Figure 5:
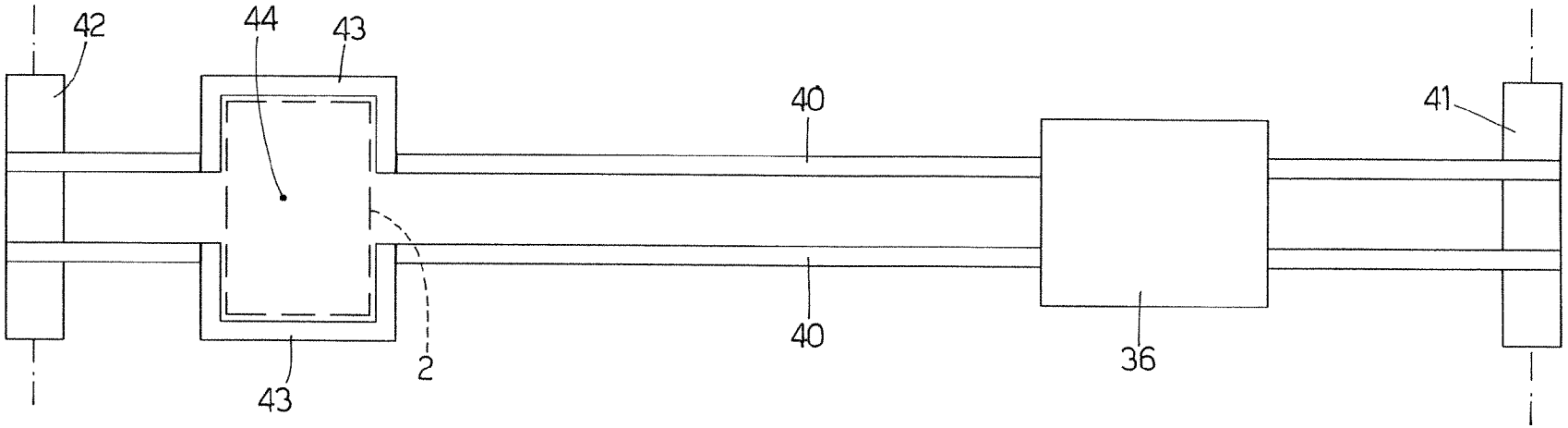
FIG. 5 shows a schematic plan view, with parts removed for clarity, of a carriage of the second transfer device in FIG. 3.

A preferred embodiment shown in FIGS. 3 and 5 comprises two belts 40 (only one shown in FIG. 3), each of which is integral with carriage 36 and wound about an idle pulley 41 and a powered pulley 42. Each belt 40 preferably comprises a toothed portion wound about powered pulley 42, which is also toothed; and a non-toothed portion wound about idle pulley 41, which is smooth. Each belt 40 comprises a U-shaped intermediate member 43 to locally increase the size of the gap between the two belts 40. In other words, the intermediate member 43 of one belt 40 and the corresponding intermediate member 43 of the other belt 40 are positioned opposite and facing each other to define, between the two belts 40, a window 44 (for the purpose described below) large enough to permit passage of a packet 2 of cigarettes.

With reference to FIG. 1, it is important to note that packets 2 of cigarettes are housed inside pockets 9 of conveyor 6 in a first position with respect to direction 8 (i.e. are "laid flat"), are housed inside pockets 12 of conveyor 10 in a second position with respect to direction 11 (i.e. are positioned "upright" or "on edge"), and are housed in pockets 25 of conveyor 23 in the first position with respect to direction 24 (i.e. are "laid flat"). More specifically, in the first position, major lateral walls 4 of each packet 2 of cigarettes are parallel to the relative direction, and minor lateral walls 5 are perpendicular to the relative direction; and, in the second position, major lateral walls 4 of each packet 2 of cigarettes are perpendicular to the relative direction, and minor lateral walls 5 are parallel to the relative direction. The two changes in the position of packets 2 of cigarettes are made by the two transfer devices 17 and 30, each of which rotates each packet 2 of cigarettes 90° about the central axis of symmetry of the packet to change the position of packet 2 of cigarettes.

As shown in FIG. 1, a heat-shrink device 45 subjects each packet 2 of cigarettes to a first heat-shrink operation along conveyor 6, and a further heat-shrink device 46 subjects each packet 2 of cigarettes to a second heat-shrink operation along conveyor 10. By virtue of the two changes in the position of packets 2 of cigarettes described above, heat-shrink device 45 heats major lateral walls 4 of each packet 2 of cigarettes, and heat-shrink device 46 heats minor lateral walls 5 of each packet 2 of cigarettes, so that the overwrapping of heat-shrink plastic material of each packet 2 of cigarettes is effectively smoothed over the whole lateral surface of the packet to obtain an extremely high finish quality.

As shown in FIG. 1, a control device 47 supervises operation of feed unit 1, and is connected to an optical sensor 48 for detecting an empty pickup member 20 (i.e. a vacancy) on transfer device 17. In an equivalent embodiment, optical sensor 48 may be located close to transfer device 17, as opposed to along conveyor 6. It should be pointed out that, operationwise, the location of optical sensor 48 is of no importance, in that a gap along conveyor 6 is automatically and predictably transmitted to transfer device 17, so the actual location of optical sensor 48 depends solely on how soon in advance the vacancy on transfer device 17 is to be detected.

Operation of feed unit 1 described above will now be described with reference to FIG. 1.

When feed unit 1 is running normally, the number of packets 2 of cigarettes coming off the cellophaning machine equals the number of packets 2 of cigarettes absorbed by the cartoning machine, so there are no empty pockets 9 (i.e. gaps) along conveyor 6; wheel 18 of transfer device 17 rotates about axis of rotation 19 in time with conveyor 6 and conveyor 10 to transfer packets 2 of cigarettes from pockets 9 of conveyor 6 to pockets 12 of conveyor 10, leaving no empty pockets 12; and wheel 31 of transfer device 30 remains in a fixed position (i.e. does not translate) and rotates about axis of rotation 32 in time with conveyor 10 and conveyor 23 to transfer packets 2 of cigarettes from pockets 12 of conveyor 10 to pockets 25 of conveyor 23, leaving no empty pockets 25.

When an empty pickup member 20 (i.e. a vacancy) is detected on transfer device 17, control device 47 stops conveyor 10 when the empty pickup member 20 is positioned facing the input end of conveyor 10, and simultaneously moves wheel 31 of transfer device 30 towards transfer device 17 in the opposite direction to direction 11, while keeping wheel 31 in time with conveyor 10 and conveyor 23 to transfer packets 2 of cigarettes from pockets 12 of conveyor 10 to pockets 25 of conveyor 23, leaving no empty pockets 25. The vacancy on transfer device 17 is thus eliminated, and there are still no gaps (i.e. empty pockets 12) along conveyor 10. In the event of a number of successive vacancies on transfer device 17, conveyor 10 is stopped until the vacancies are eliminated, and, at the same time, wheel 31 of transfer device 30 is moved towards transfer device 17.

Eliminating the vacancies on transfer device 17 as described above may obviously continue until wheel 31 of transfer device 30 reaches a limit stop close to transfer device 17; in which case, gaps (i.e. empty pockets 25) are inevitably formed along conveyor 23. Accordingly, control device 47 controls feed unit 1 to create along conveyor 23 a number of gaps which is a multiple of the number of packets 2 of cigarettes in each group of packets 2 of cigarettes. That is, when the cartoning machine receives a number of gaps equal to the number of packets 2 of cigarettes in each group of packets 2 of cigarettes, it performs a so-called "carton skip", i.e. cuts off supply of the packing materials, and performs a no-load cycle to avoid producing any rejects. In other words, when the vacancies on transfer device 17 can no longer be compensated, the remaining vacancies are transferred successively to conveyor 23, so they always equal a multiple of the number of packets 2 of cigarettes in each group of packets 2 of cigarettes, and the cartoning machine can perform even repeated "carton skips" to avoid producing rejects.

On nearing the limit stop close to transfer device 17, wheel 31 of transfer device 30 may be moved in direction 24 away from transfer device 17 into an intermediate position between its two limit stops, while at the same time forming along conveyor 23 a number of consecutive empty pockets 25 (gaps) equal to the number of packets 2 of cigarettes in each group of packets 2 of cigarettes. In which case, the cartoning machine again performs a "carton skip" to avoid producing rejects.

In the event of deceleration or stoppage of conveyor 23 (i.e. of the cartoning machine), control device 47 moves wheel 31 away from transfer device 17 in direction 24; and, when wheel 31 reaches the opposite limit stop to transfer device 17, control device 47 rejects the surplus packets 2 of cigarettes on conveyor 10. This situation is caused by the greater inertia of the cellophaning machine preventing it from slowing down or stopping as fast as the cartoning machine, with the result that, in the event of sharp deceleration (or sudden stoppage) of the cartoning machine, a certain number of packets 2 of cigarettes are inevitably fed onto conveyor 10, and, not being feedable to the cartoning machine, are necessarily rejected.

To reject the surplus packets 2 of cigarettes on conveyor 10, control device 47 moves transfer device 30 into a withdrawn position, moves conveyor 10 forwards to feed the packets 2 of cigarettes in direction 11 to the output end of conveyor 10, and allows the packets 2 of cigarettes to drop by force of gravity off the output end of conveyor 10 into a station (not shown) located beneath the output end to collect the reject packets 2 of cigarettes. The withdrawn position of transfer device 30 is obviously such as to allow packets 2 of cigarettes to travel freely along conveyor 10 and drop freely off the output end of conveyor 10. Consequently, to move transfer device 30 into the withdrawn position, carriage 36 is withdrawn from the output end of conveyor 10, and arm 38 is rotated downwards about axis of rotation 39. Moreover, when transfer device 30 is in the withdrawn position, the window 44 defined between the two belts 40 is aligned vertically with the output end of conveyor 10 to allow packets 2 of cigarettes to drop into the collecting station.

Feed unit 1 as described above has numerous advantages: it provides for positioning heat-shrink devices 45 and 46 as required to obtain high-quality plastic overwrappings of packets 2 of cigarettes; and copes excellently with sharp deceleration (or sudden stoppages) of the cartoning machine, so any packets 2 of cigarettes that cannot be fed to the cartoning machine are rejected.

The invention claimed is:

1. A method of heat-shrinking overwrappings of heat-shrink plastic material of a succession of products (2); the method comprising the steps of:

conveying, by means of conveying means, an orderly succession of products (2), each having an overwrapping of heat-shrink plastic material;

subjecting each product (2) to a first heat-shrink operation along the conveying means and by means of a first heat-shrink device (45); and subjecting each product (2) to a second heat-shrink operation along the conveying means and by means of a second heat-shrink device (46) separate and at a distance from the first heat-shrink device (45);

wherein the conveying means comprises a first conveyor (6) connected to the first heat-shrink device (45), and which feeds the products (2) in a first direction (8), and a downstream second conveyor (10) connected to the second heat-shrink device (46), and which feeds the products (2) in a second direction (11); and the method comprising the further steps of:

feeding the products (2) along the first conveyor (6) in a first position with respect to the first direction (8);

changing the position of the products (2) by means of a transfer device (17) interposed between the first conveyor (6) and the second conveyor (10), and which transfers the products (2) from the first conveyor (6) to the second conveyor (10); and feeding the products (2) along the second conveyor (10) in a second position, different from the first position, with respect to the second direction (11).

2. A method as claimed in claim 1, wherein each product (2) is in the form of a rectangular parallelepiped, and comprises two parallel end walls (3), two parallel major lateral walls (4), and two parallel minor lateral walls (5); in the first position, the major lateral walls (4) are parallel to the first direction (8), and the minor lateral walls (5) are perpendicular to the first direction (8); and, in the second position, the major lateral walls (4) are perpendicular to the second direction (11), and the minor lateral walls (5) are parallel to the second direction (11).

3. A method as claimed in claim 1, wherein each product (2) is in the form of a rectangular parallelepiped, and comprises two parallel end walls (3), two parallel major lateral walls (4), and two parallel minor lateral walls (5); and the first heat-shrink device (45) heats different walls (3; 4; 5) of each product (2) with respect to the second heat-shrink device (46).

4. A method as claimed in claim 3, wherein the first heat-shrink device (45) heats the major lateral walls (4) of each product (2), and the second heat-shrink device (46) heats the minor lateral walls (5) of each product (2).

5. A unit for heat-shrinking overwrappings of heat-shrink plastic material of a succession of products (2); the unit comprising:

conveying means for conveying an orderly succession of products (2), each having an overwrapping of heat-shrink plastic material;

a first heat-shrink device (45) located along the conveying means to subject each product (2) to a first heat-shrink operation; and a second heat-shrink device (46) located along the conveying means and separate and a distance from the first heat-shrink device (45) to subject each product (2) to a second heat-shrink operation after the first heat-shrink operation;

wherein the conveying means comprises a first conveyor (6) connected to the first heat-shrink device (45), and which feeds the products (2) in a first direction (8), and a downstream second conveyor (10) connected to the second heat-shrink device (46), and which feeds the products (2) in a second direction (11); and wherein the products (2) are fed along the first conveyor (6) in a first position with respect to the first direction (8), and are fed along the second conveyor (10) in a second position, different from the first position, with respect to the second direction (11); and a transfer device (17) is interposed between the first conveyor (6) and the second conveyor (10) to transfer the products (2) from the first conveyor (6) to the second conveyor (10), and to change the position of the products (2);

wherein each product (2)is in the form of a rectangular parallelepiped, and comprises two parallel end walls (3), two parallel major lateral walls (4), and two parallel minor lateral walls (5); in the first position, the major lateral walls (4) are parallel to the first direction (8), and the minor lateral walls (5) are perpendicular to the first direction (8); and, in the second position, the major lateral walls (4) are perpendicular to the second direction (11), and the minor lateral walls (5) are parallel to the second direction (11).

6. A unit as claimed in claim 5, wherein each product (2) is in the form of a rectangular parallelepiped, and comprises two parallel end walls (3), two parallel major lateral walls (4), and two parallel minor lateral walls (5); and the first heat-shrink device (45) heats different walls (3; 4; 5) of each product (2) with respect to the second heat-shrink device (46).

7. A unit as claimed in claim 6, wherein the first heat-shrink device (45) heats the major lateral walls (4) of each product (2), and the second heat-shrink device (46) heats the minor lateral walls (5) of each product (2).

* * * * *